US005320713A

United States Patent [19]

Bubik et al.

[11] Patent Number: 5,320,713

[45] Date of Patent: Jun. 14, 1994

[54] METHOD OF USING A FORMING SECTION OF A PAPERMAKING MACHINE

[75] Inventors: Alfred Bubik; Hans Dahl, both of Ravensburg; Otto Hildebrand, Ravensburg-Taldorf; Karl Muller, Ringgenweiler; Jorg Walter, Ravensburg, all of Fed. Rep. of Germany

[73] Assignee: Sulzer Escher Wyss GmbH, Ravensburg, Fed. Rep. of Germany

[21] Appl. No.: 63,957

[22] Filed: May 20, 1993

Related U.S. Application Data

[62] Division of Ser. No. 644,519, Jan. 23, 1991, abandoned.

[30] Foreign Application Priority Data

Jan. 26, 1990 [DE] Fed. Rep. of Germany .... 4002304.4

[51] Int. Cl.[5] ..... D21F 1/00

[52] U.S. Cl. ..... 162/203; 162/217; 162/300; 162/301

[58] Field of Search ..... 162/203, 217, 300, 301, 162/352

[56] References Cited

U.S. PATENT DOCUMENTS

| | | | |
|---|---|---|---|
| 3,994,774 | 11/1976 | Halme et al. | 162/301 |
| 4,154,645 | 5/1979 | Kankaanpää | 162/301 |
| 4,769,111 | 9/1988 | Nevalainen et al. | 162/301 |
| 4,830,709 | 5/1989 | Turner et al. | 162/203 |
| 5,045,153 | 9/1991 | Sollinger et al. | 162/301 |
| 5,141,600 | 8/1992 | Meinecke et al. | 162/301 |

FOREIGN PATENT DOCUMENTS

| | | |
|---|---|---|
| 0251778 | 1/1988 | European Pat. Off. . |
| 0251779 | 1/1988 | European Pat. Off. . |
| 3138133 | 3/1983 | Fed. Rep. of Germany . |
| 3153305 | 3/1983 | Fed. Rep. of Germany . |
| 3406217 | 10/1985 | Fed. Rep. of Germany . |
| 3503242 | 8/1986 | Fed. Rep. of Germany . |
| 3546629 | 8/1986 | Fed. Rep. of Germany . |
| WO89/11000 | 11/1989 | PCT Int'l Appl. . |

OTHER PUBLICATIONS

"New Top-Wire Forming Unit Provides Flexibility, Retrofit on Fourdrinier", W. Baumann, *Pulp & Paper*, Apr. 1989, pp. 130–132.

*Primary Examiner*—Karen M. Hastings

*Attorney, Agent, or Firm*—Sandler Greenblum & Bernstein

[57] ABSTRACT

In order to regulate dewatering of the fiber suspension and the formation of the paper web between the upper and lower wires of the papermaking machines, upper ledges are provided along with the upper wire. These upper ledges are particularly constructed so as to have uniform design. Between these upper ledges, there is left free the same distance or spacing. This distance is not smaller than the width of each upper ledge. The individual distances between the upper ledges can be closed by insertable inserts so that the dewatering can be forcibly accomplished at mutually separated zones. Along the lower wire, there are provided lower ledges at a table, and between these lower ledges, it can be adjusted varying distances or spacing therebetween. The mutual distance or spacing between the lower ledges, according to a favorable construction, is always greater than the width of the individual upper ledges plus the distance or spacing of an upper ledge from the next neighboring upper ledge. The lower ledges can be mounted at the table so as to be lengthwise displaceably and individually adjustable in the direction of the lower wire. The table can be selectably positioned vertically as well as horizontally relative to the lower wire. All of these measures also can be accomplished during operation of the papermaking machine. The individual lower ledges are elastically supported against the table and this table is elastically supported against its foundation. It is possible to undertake the web forming operation, during operation of the papermaking machines, in accordance with technological requirements and the time wise as well as localized situations, while protecting the paper web which is to be formed and equally the equipment which is to be operated.

13 Claims, 2 Drawing Sheets

METHOD OF USING A FORMING SECTION OF A PAPERMAKING MACHINE

CROSS-REFERENCE TO RELATED APPLICATION

This application is a division of application Ser. No. 644,519, filed on Jan. 23, 1991, now abandoned.

BACKGROUND OF THE INVENTION

1. Field of the Invention

The present invention broadly relates to the papermaking art and, more specifically, concerns a new and improved forming section or former for a papermaking machine as well as an advantageous method of use thereof.

2. Discussion of the Background and Material Information

Generally speaking, the forming section of the present development for a papermaking machine serves to form a paper web or sheet between a top or upper wire and a lower wire during dewatering of a fiber suspension or fiber stock between the wires. There is employed at both sides of these wires, at the top as well as at the bottom, ledge members or ledges which are arranged along the line of the web forming path and which extend in the cross-machine direction. These ledges are adjustable relative to the wires and contact such wires during operation of the papermaking machine. The ledges are arranged at the upper wire and the lower wire in spaced relationship to one another so that spaces or distances are formed between the neighboring ledges and there are left free gaps for the discharge of the liquid which is to be removed during the dewatering operation.

Forming sections or former of the aforementioned construction can be operated in the direct neighborhood of a headbox. The fiber suspension or stock is sprayed in the form of a flat jet into the intermediate space which is formed by virtue of the convergence of the wires and thereafter such injected fiber suspension is dewatered between the wires. These forming sections can be, however, also provided with a pre-dewatering section or path in which there is ensured that the fiber suspension or stock which effluxes from the headbox is guided upon one of the wires throughout a certain path, and already prior to entry of the fiber suspension into the forming section there is removed a part of the contained water out of the fiber suspension or stock, especially in a downward direction. The pre-dewatering path then follows the forming section of the here described type, and, as a general rule, the pre-dewatered fiber stock or suspension remains reposing upon the wire and through the utilization of a further wire the forming section or former is constructed as a so-called twin wire forming section.

With heretofore known forming sections or formers of the aforementioned type, for instance as known from U.S. Pat. No. 4,769,111, German Patent No. 3,138,133, German Patent No. 3,153,305, German Patent No. 3,546,629 and European Patent No. 0,251,778, a multiplicity of ledges are arranged uniformly distributed over the entire length of the web forming section or path. Through the use of these ledges there is intended to be achieved an improvement in the web formation. It can happen that such distribution of the ledges can lead to damage of the formed paperweb or sheet, particularly at those locations of the web formation section or path which are located behind or upstream of the so-called waterline.

In other constructions of the forming section there is employed from the opposite side a ledge or ledge member which, in each instance, is directed towards the oppositely situated dewatering gap or slot. Such an arrangement is provided at each dewatering gap or slot and there is employed an appreciable pressure, so that the liquid can be expressed out of the paper web or sheet. Under certain circumstances, this pressure can be so great that the paper web which is to be formed is crushed between the wires. In the event of an absence of the pressure, or else if the pressure is too low, then the paper web can be retromoistened from above by the application of the previously expelled liquid, and consequently, this paper web is disadvantageously altered. With the high pressures which are to be applied also the wires are adversely affected and are prematurely worn. Because of the small spacing between the ledges there is a tendency for the intermediate gap between the ledges to become contaminated by, for instance, too much fiber and ash which has been removed from the paper web or sheet.

The forming section or former which is known from German Patent No. 3,546,629 has the lower ledges or ledge members mounted upon a flexible plate. However, with this prior art construction the water which is removed in a downward direction must be laterally discharged between the ledges. As a result, the quantity of removed water is limited and there exists the danger of contamination or soiling of the forming section. Moreover, there cannot be adjusted any individual contact or pressing force of the ledges and the reproducibility of the adjustment is unsatisfactory.

If, as taught for instance in the European Patent No. 0,251,778, a multiplicity of ledges or ledge members located at the lower wire are mounted upon a rigid frame, then there is particularly great the danger of excessively compressing the paper web, damaging the wires and so forth. With this prior art construction of forming section there is also limited the removal of the water and there is simultaneously present an appreciable danger of contaminating the forming section.

With the heretofore known arrangements the provision of the ledges at the lower wire increases the wear of the wire. There is also increased the wire throughput, that is to say, too great a quantity of fines and ashes are washed out of the paper web or sheet. With the heretofore known constructions of forming sections, the web forming pulses, which act upon the ledges, are automatically too high and frequently, as a result thereof, they cause an impairment in the web or sheet formation when working with shear-force sensitive materials.

SUMMARY OF THE INVENTION

Therefore, with the foregoing in mind it is a primary object of the present invention to provide an improved forming section for a papermaking machine and a method of using the same, wherein there are avoided or at least appreciably minimized the aforementioned drawbacks of the prior art.

Another important and more specific object of the present invention aims at the provision of an improved construction of forming section for a papermaking machine wherein there is rendered possible accommodating the web dewatering and the web formation to different technological conditions which arise along the path of the web forming section, primarily the altering position of the waterline of the paper web between the wires, by appropriately positioning the ledges or ledge members relative to the paper web, that is to say, to act upon the ledges in as protective a fashion as possible only in accordance with the actual prevailing localized requirements, so that the web or sheet which is to be formed is not damaged.

In keeping with the previously enumerated object, it is a further object of the invention to provide an improved construction of forming section for a papermaking machine wherein there is reduced the wear of the wires and there is improved the removal of the water out of the paper web or sheet.

Yet a further significant object of the present invention aims at the provision of an improved construction of forming section for a papermaking machine wherein the positioning of the ledge members or ledges, which is to be undertaken in accordance with prevailing requirements, also can be accomplished during the operation of the papermaking machine.

Now in order to implement these and still further objects of the invention, which will become more readily apparent as the description proceeds, the forming section for a papermaking machine as contemplated by the present development, among other things, is manifested by the features that the width and the position of the ledges which contact the wires during operation and also the distance or spacing between the ledges are accommodated to one another such that at least each second gap, i.e., each successively alternate gap, between the ledges located at the upper or top wire is not completely or partially covered by a ledge or ledge member located at the lower wire.

As alluded to above, the invention is not only concerned with the aforementioned improved construction of forming section but also relates to a method of use of such forming section in a combination of a longitudinal wire and twin-wire papermaking machine. In particular, it is contemplated to pre-dewater the fiber suspension which is to be dewatered prior to reaching the forming section upon a longitudinal or lengthwise extending wire, that at the region of the forming section the upper wire is infed in such a manner that there is formed between these wires the receiving or take-up compartment for the fiber suspension which is to be further dewatered, and that the longitudinal or lengthwise extending wire produces within the forming section the action of a lower wire.

The inventive method further contemplates introducing the fiber suspension or stock which is to be dewatered, by means of a headbox, in the form of a flat jet, into the fiber suspension or stock receiving or take-up compartment or space which is formed due to guiding together or convergence of the wires. It is also possible to provide upstream or forwardly of the forming section a forming cylinder which is entrained or wrapped by the top or upper wire. It is equally possible to provide upstream or forwardly of the forming section a forming cylinder which is wrapped or entrained by the lower wire.

The dewatering of the paper web and the web formation is accomplished in a protective fashion in accordance with the local technological conditions or characteristics of the web and in accordance with the actual prevailing localized requirements.

BRIEF DESCRIPTION OF THE DRAWINGS

A better understanding of the invention will be had by now referring to specific examples of the invention with reference to the drawings, wherein.

DETAILED DESCRIPTION OF THE PREFERRED EMBODIMENTS

Figure 1:
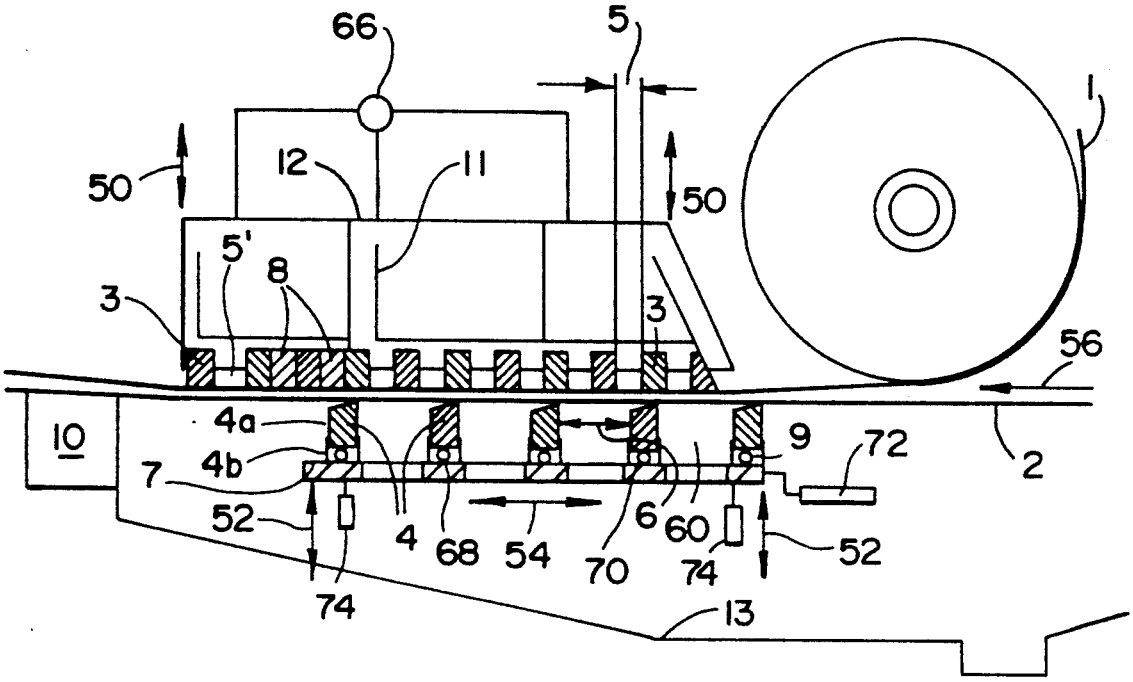
FIG. 1 schematically illustrates in side view part of a forming section or former of a papermaking machine.

Describing now the drawings, it is to be understood that only enough of the construction of the papermaking machine and its forming section or former have been shown in the drawings, in order to simplify the illustration thereof, as needed for one skilled in the art to readily understand the underlying principles and concepts of the present development.

Turning attention now to the drawings, there is schematically depicted therein the inventive forming section or former for a papermaking machine. Such forming section or former can advantageously also be utilized, in correspondingly adapted form, in a cardboard making machine. Therefore, in the context of this disclosure the term "papermaking machine" is also intended to encompass a cardboard making machine.

With reference first to the embodiment of forming section depicted in the exemplary embodiment shown in FIG. 1, it will be recognized that between a top or upper wire 1 and a lower or bottom wire 2 there is formed a paper web or sheet, if desired also a cardboard web or sheet. During operation of the papermaking machine the fiber suspension or stock, which is located between the wires 1 and 2, is dewatered and there is thus formed the paper web or sheet. This paper web or sheet should constitute a homogeneous structure. The dewatering of the paper web and the web formation is accomplished while employing ledges or ledge members 3 and 4. The ledges or ledge members, designated by reference numeral 3 in FIG. 1, are located above the upper wire 1, and the remaining group of ledges or ledge members which are located beneath the lower wire 2, are conveniently designated by reference numeral 4. These ledges or ledge members 3 and 4 are arranged along the web forming path or forming section, extend transversely with respect to the direction of extent of the papermaking machine, in other words extend in the cross-machine direction, and are positionally adjustable relative to the wires 1 and 2, respectively.

Figure 4:
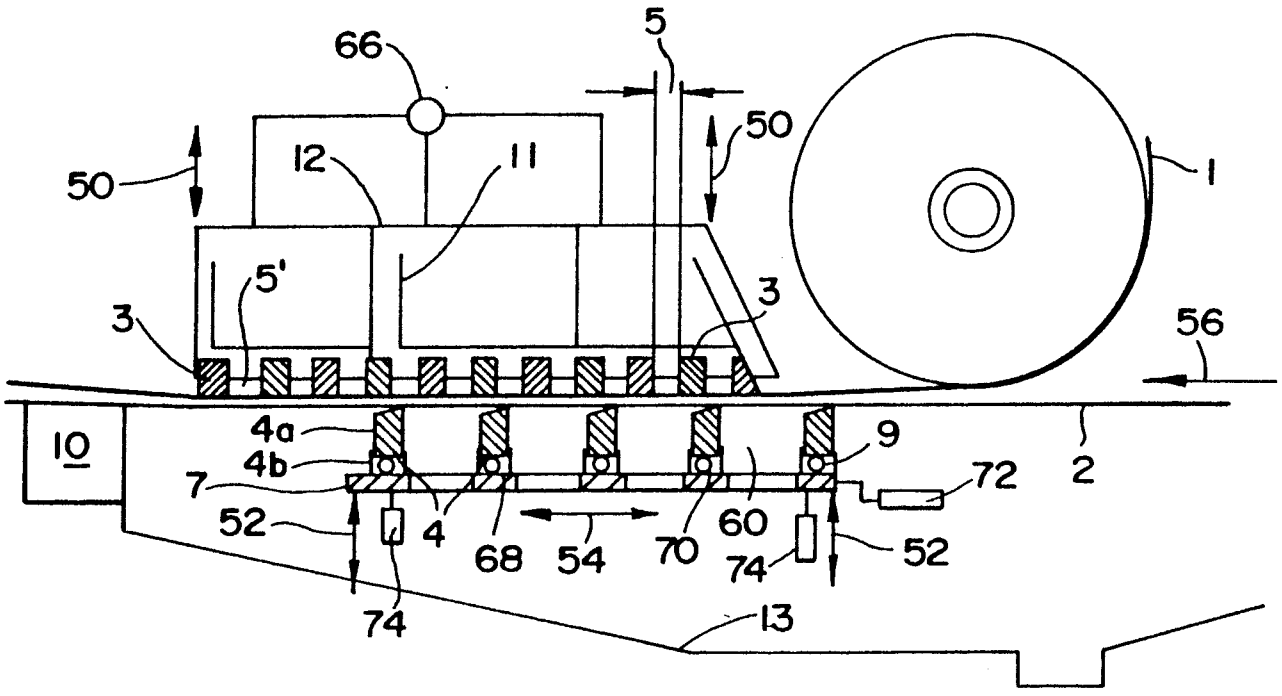
FIG. 4 schematically illustrates part of a different construction of forming section or former, viewed from the side, and having a special arrangement of the ledges or ledge members.

During operation of the papermaking machine, these ledges 3 and 4 contact the correspondingly confronting wire 1 and 2, respectively, and which wires 1 and 2 pass in supported fashion past these ledges 3 and 4, respectively. A part of the conceivable adjustment movements of the ledges 3 and 4 has been schematically indicated by the thick double-headed arrows 50, 52 and 54 respectively. The ledges 3 are arranged in mutual spaced relationship so as to form therebetween the distances or spaces 5, and equally, the ledges 4 are arranged in mutually spaced relationship from one another so as to form therebetween the distances or spaces 6, as best seen by referring to FIG. 1. Consequently, between the spaced upper ledges 3 there are formed slots 58 and between the spaced lower ledges 4 there are formed slots 60. These slots 58 and 60 extend transversely to the direction of travel, generally indicated by reference numeral 56, of the formed paper web, in other words extend in the cross-machine direction. At these slots 58 and 60 there occurs the outflow of the liquid, typically water, which is to be removed from the fiber suspension or stock located between the wires 1 and 2. The removal of such liquid occurs at both sides of the forming section, in other words, away from the upper or top wire 1 as well as away from the lower or bottom wire 2. FIGS. 1 and 4 depict two exemplary embodiments of the arrangement of the ledge members or ledges 3 and 4 relative to one another, as will be explained more fully hereinafter.

It will be recognized by again referring to FIG. 1, that the ledges or ledge members 4, intended to contact the lower wire 2, are arranged such that the water which is removed by these ledges 4 out of the lower wire 2, is directly downwardly withdrawn and can arrive along a direct path at a suitable water catch device or receptacle 13. It will be further recognized, again by inspecting FIG. 1, that a separation suction device or means 10 follows the forming section and such ensures for the proper deposition of the moist paper web or sheet upon the lower wire 2.

Figure 2:
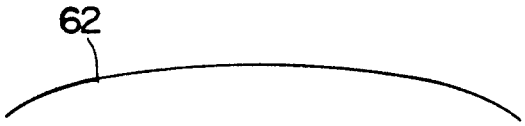
FIG. 2 illustrates a curve along which there can be designed the forming section or former of the papermaking machine.
Figure 3:
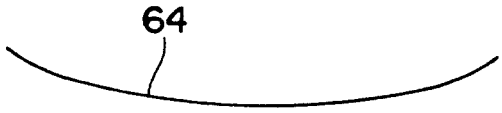
FIG. 3 illustrates a different curve configuration along which there can be designed the forming section or former of a papermaking machine.

As far as the upper ledges or ledge members 3 are concerned, which are intended to contact the upper or top wire there are available different known advantageous constructional shapes or configurations which can be used. The sides or ends of these ledges 3 which confront the associated upper or top wire 1, form a contact or bearing surface which defines the spatial configuration of the web forming section or path. This bearing or contact surface forms, for instance, a grid-like base surface of a housing 12 for collecting and withdrawing the liquid which flows through the gaps 5' between the upper ledges 3 during operation of the papermaking machine. This grid-like base surface confronts the upper or top wire 1, as best seen by referring to FIG. 1. The ledges 3, as stated, are arranged at the mutual distance or spacing 5 along the surface of the forming section so that there arise the aforementioned gaps 5' and the associated slots 58. The spatial configuration of the forming section can be constituted by a straight line, as is the case for the embodiment of FIG. 1. However, this spatial configuration of the forming section can also be formed by a concave curve 62 is shown in FIG. 2 or a convex curve 64 as shown in FIG. 3, or else by an approximately undulated or wave-shaped curve course or other desired curve course.

Continuing, it will be understood that the ledges or ledge members 4, intended to wipingly and supportingly contact the lower wire 2, are designed in each case in accordance with an advantageous configuration or shape. These ledges 4 can possess minor differences in shape from one another, for instance, as concerns the design of the ledge head or end portion which confronts the lower wire 2.

The width and the position of the ledges 3 and 4 which contact the related wires 1 and 2, respectively, during operation of the papermaking machine and the distances or spacings 5 and 6 between the ledges 3 and 4, respectively, are accommodated to one another such that at least each second gap 5' between the ledges 3 located at the upper or top wire 1 is not completely or partially covered by or coincident with a ledge 4 located at the lower wire 2. The upper ledges are spaced apart by distances different from distances by which the lower ledges are spaced apart. In particular, the lower ledges can be spaced apart in a predetermined manner such that at least one of the upper ledges is positioned above and between, at least partially, a gap between a pair of lower ledges, but that at least each second gap between the upper ledges is neither completely nor partially covered by a lower ledge and is downstream of one of the lower ledges and is upstream of another of the lower ledges. It is an advantage of the forming section of the present development that, also viewed transversely with respect to the web travel direction 56, and because of the relatively large spacing between the ledges 3 and 4, large tolerances are permissible without any drawback as concerns the dimensional accuracy of the head or end portions of the ledges 4 confronting the lower wire 2. The possibilities of favorably influencing the web formation operation, can also be additionally improved by an intentionally generated ledge irregularity over the width of the ledges 4. There also can be conceivably employed a correction of the shape of the head or end portion of the ledges 4, which is undertaken over the ledge width, especially during the operation of the papermaking machine, for instance by accomplishing a zone-wise regulatable deformation of the head or end portions of the ledges 4. The upper and lower ledges thereby are forming ledges that influence web formation.

Continuing, it is to be understood that the ledges or ledge members 4 are arranged at a uniform or non-uniform distance or spacing 6 along the forming section upon a table or table member 7 which can be selectively positioned relative to the lower wire 2. According to a particularly advantageous embodiment, the individual ledge distance or spacing 6 is greater in each instance than the sum of the width of an individual oppositely situated ledge 3 located at the upper wire 1 and the distance or spacing 5 to the neighboring ledge 3 located at the upper or top wire 1, viewed in the lengthwise direction of the papermaking machine, in other words in the direction of web travel 56.

The teachings of the invention were utilized in conjunction with a forming section or former having a length in the order of about 500 to 3000 mm, particularly as measured above the upper or top wire 1. There was employed ledges 3 and 4, each having a width between 10 to 60 mm. The number of upper ledges 3 may be as many as 40 ledges. The number of lower ledges 4 beneath the lower wire 2 can amount to as many as 20 ledges. An advantage of the invention resides in the fact that at the formation surface containing the ledges or ledge members 3, depending upon the technological requirements, there can be formed a predetermined number of zones, for instance 1 to 10 zones. A number or all of the water discharge or withdrawal slots 58 which follow one another in the lengthwise direction of the papermaking machine and each of which water discharge slots 58 has a width distance or spacing 5, can be closed by inserts or insert members 8 having the same width distance or spacing 5, so that in each instance a lengthwise section of the forming surface is without any suction action. This can be undertaken constructively such that these inserts 8, which bound the individual zones, can be inserted as required, also during operation of the papermaking machine, from the side into the corresponding mutual ledge distance or spacing 5, in other words into the relevant water withdrawal or discharge slot 58. The individual dewatering gaps 5' advantageously also can be impinged with different vacuums. To this end, there can be employed, for instance, the schematically depicted partial or separation walls 11 located in the housing 12 and a suction installation, generally indicated by reference numeral 66, which can be adjusted to a number of different negative pressures.

The ledges or ledge members 4, which are intended to contact the lower wire 2, are selectively positionally mounted at the table 7 in the lengthwise direction or direction of extent of the papermaking machine. This table 7 advantageously can be elevationally positioned, inclined and lengthwise displaceable relative to the lower wire 2, also during operation of the papermaking machine. It will be thus understood that the ledges 4 are not fixedly connected at a given location with the table or table member 7. This selective positionable orientation of the ledges 4 at the table 7 can be accomplished, for instance, by providing at the surface of the table 7 a number of grooves, generally indicated by reference numeral 68 in FIG. 1, which extend in the cross-machine direction. The ledges 4 which can be designed to possess a dovetail-connection, then can be selectively inserted into and withdrawn from appropriate ones of these grooves 68. In this manner the ledges 4, depending upon requirements, can be positionally shifted to another location at the table 7, also during operation of the papermaking machine, in that the ledges 4 are retracted from the side of the papermaking machine out of a previous position defined by a related groove 68 and introduced into a newly desired position, in other words inserted into a different groove 68.

The ledges or ledge members 4 which are intended to contact the lower wire 2, are supported at the table 7 and are individually positionably adjustable in the direction of the lower wire 2. Each ledge member or ledge 4 can be adjusted in its height. It is particularly advantageous if these ledges 4 are positionally elevationally adjusted by a fluid medium, in other words pneumatically or hydraulically. During operation of the papermaking machine, these ledges 4 can be elastically yieldingly supported at an associated fluid cushion, for instance an air cushion 9, against the table 7, in that these ledges 4 possess, for instance, two mutually interfitting telescopic parts **4*a* and 4*b* between which there is arranged an expansible fluid operated, for instance air bellows 70 defining the air cushion 9**.

An advantageous possibility of accommodating the forming section to the technological paper fabrication requirements is realized by virtue of the adjustment possibility of the table 7 in the wire travel direction and opposite to such wire travel direction. To this end, any suitable table adjustment mechanism 72, such as a piston and cylinder unit can be employed. As a result, the position of the ledges or ledge members 4 can be altered relative to the ledges or ledge members 3, providing a positive effect during the web formation. Depending upon the use of the forming section it is conceivable that, as viewed in the wire travel direction, the first and/or the last ledge of the formation section constitutes a ledge 4 which is effective at the lower wire 2.

It is further advantageous if the table 7 in conjunction with the positionably adjustable and flexibly supported ledges 4 is supported against its foundation at fluid bellows, for instance air bellows generally indicated by reference character 74 in FIG. 1, in order to be able to position this table 7 in conjunction with the ledges 4 vertically with respect to the lower wire 2. With this design the table 7 and the thereat mounted ledges 4 are pneumatically elastically mounted.

The ledges 3 which are intended to contact the upper or top wire 1 and the ledges 4 which are intended to contact the lower wire 2, in each case form a contact or bearing surface at the side thereof which confronts the associated wire 1 and 2, respectively. These contact or bearing surfaces can intersect one another or not intersect one another. Moreover, it is possible to provide laterally of the twin wire arrangement adjustment elements for adjusting the spacing between attachment components which carry the ledges 4 contacting the lower wire 2 and the attachment components which carry the ledges 3 contacting the upper or top wire 1. Furthermore, the ledges 3 and 4 which, during operation of the papermaking machine, contact the associated wires 1 and 2, respectively, need not be planar or flat at least partially at their surface confronting the related wire, as viewed over the width of the corresponding ledge. It is also possible to design the ledges 4 which contact the lower wire 2 during operation of the papermaking machine such that they at least partially are individually deformable over their width at the ledge surface which confronts the related wire 2.

The described measures, which also can be undertaken during operation of the papermaking machine, namely the zone formation along the contact or bearing surface containing the ledges 3, the selective positioning of the ledges 4 at the table 7, the individual positional adjustment of the ledges 4 and the selective positioning of the table 7, allow the papermaker the possibility to accomplish the web dewatering and the formation of the web between the wires in accordance with prevailing technological requirements and the encountered situation throughout a large operating range. All of the initially mentioned problems which arise at the forming section can be overcome or at least substantially minimized. The invention renders possible the achievement of a protective operation at the forming section, as such concerns the paper web or sheet which is to be formed as well as also the revolving wires or the like. Contributing thereto is the fact that also there are provided the pneumatic elastic support of the ledges 4 and the table 7, which enable elastically compensating any sudden locally arising increase in the thickness of the fiber suspension or stock between the travelling wires without damaging the paper web or the wires.

Although the present invention has been described in some detail by way of illustration and example for purposes of clarity of understanding, it is understood that certain changes and modifications may be made within the spirit of the invention.

What is claimed:

1. A method of using a forming section in a combination of longitudinal wire and twin-wire papermaking machine, the forming section comprising forming ledges arranged to both sides of an upper wire and a lower wire arranged along the forming section, the upper wire and the lower wire being movable in an upstream-to-downstream direction between which is formed a paper web, the forming ledges comprising at least three upper forming ledges and at least two lower forming ledges, the at least three upper ledges being located opposite the at least two lower ledges, the upper ledges contacting the upper wire during operation of the papermaking machine, the lower ledges contacting the lower wire during operation of the papermaking machine, the upper ledges being arranged in spaced relationship at a predetermined distance from one another to define gaps there between for removal of liquid during dewatering of the paper web, the lower ledges being arranged in spaced relationship at a predetermined distance from one another to define gaps therebetween for removal of liquid during dewatering of the paper web, the upper ledges being spaced apart by distances different from distances by which the lower ledges are spaced apart, each of the ledges having a predetermined width and assuming a predetermined position, the predetermined width and the predetermined position of the ledges and the predetermined distance of the ledges from one another being correlated to one another such that at least each second gap between the upper ledges is neither completely nor partially covered by a lower ledge and is downstream of one of the lower ledges and is upstream of another of the lower ledges, said method comprising the steps of:

pre-dewatering a fiber suspension prior to reaching the forming section upon a single longitudinal wire;

infeeding the upper wire at the forming section such that between the upper wire and the lower wire there is formed a receiving compartment for the fiber suspension which is to be dewatered; influencing the formation of the paper web with the at least three upper forming ledges and the at least two lower forming ledges;

the longitudinal wire is the lower wire in the forming section; and supporting the at least two lower forming ledges on a common moveable table.

2. The method of using the forming section as defined in claim 1, further including the steps of:

providing a forming cylinder wrapped by the upper wire at a location upstream of the forming section.

3. A method of using the forming section as defined in claim 1, further including the step of:

providing a forming cylinder wrapped by the lower wire at a location upstream of the forming section.

4. The method of using a forming section as defined in claim 1, wherein:

the forming section is substantially horizontally arranged.

5. A method of using a forming section as defined in claim 1, further comprising the step of:

providing the movable table with means for moving the table along the lower wire and toward and away from the lower wire.

6. A method of using a forming section as defined in claim 5, further comprising the step of:

providing the at least two lower ledges with means for individual position adjustment toward and away from the lower wire.

7. A method of using a forming section of a papermaking machine, the forming section comprising: an upper wire extending lengthwise in a direction of movement; a lower wire extending in the forming section generally in the lengthwise direction of movement of the upper wire so that the upper wire and the lower wire form therebetween a paper web during dewatering of a fiber suspension between the upper wire and the lower wire; at least three upper forming ledges extending transversely to the lengthwise direction of movement; at least two lower forming ledges extending transversely to the lengthwise direction of movement; the at least three upper ledges being located opposite the at least two lower ledges; the upper ledges contacting the upper wire during movement of the upper wire; the lower ledges contacting the lower wire during movement of the lower wire; the upper ledges being spaced apart in a predeterminate manner such that at least one of the upper ledges is positioned above and between, at least partially, a gap between a pair of lower ledges, but that at least each second gap between the upper ledges is neither completely nor partially covered by a lower ledge, the method comprising the steps of:

applying a force by means of which the at least two lower ledges support and contact the lower wire;

locating a fiber suspension between the upper wire and the lower wire in the forming section, the fiber suspension including a predeterminate amount of liquid; influencing the formation of the paper web with the at least three upper forming ledges and the at least two lower forming ledges;

permitting liquid from the fiber suspension to outflow from the fiber suspension at least through gaps between respective pairs of the lower ledges; and supporting the at least two lower forming ledges on a common moveable table.

8. The method of using the forming section is defined in claim 7 in a twin-wire papermaking machine, further including the step of:

infeeding the fiber suspension which is to be dewatered, by means of a headbox in the form of a flat jet, into the receiving compartment for the fiber suspension which is formed by convergence of the upper and lower wires.

9. A method of using a forming section as defined in claim 7, wherein the forming section further comprises an upper liquid removal housing, the upper ledges forming a base surface for the upper liquid removal housing and the at least two lower ledges being positioned opposite the upper liquid removal housing, the method further comprising the step of:

removing liquid from the fiber suspension by means of the upper liquid removal housing.

10. A method of using a forming section as defined in claim 7, further comprising, during the step of permitting liquid to outflow from the fiber suspension, the step of:

elastically supporting the at least two lower ledges.

11. A method of using a forming section as defined in claim 7, the method further comprising:

pre-dewatering the fiber suspension prior to reaching the forming section.

12. A method of using a forming section as defined in claim 7, further comprising the step of:

providing the movable table with means for moving the table along the lower wire and toward and away from the lower wire.

13. A method of using a forming section as defined in claim 12, further comprising the step of:

providing the at least two lower ledges with means for individual position adjustment toward and away from the lower wire.

* * * * *